US006710685B1

(12) United States Patent
Sciarrino

(10) Patent No.: US 6,710,685 B1
(45) Date of Patent: Mar. 23, 2004

(54) WAVEGUIDE INTERCONNECTION SYSTEM

(76) Inventor: Matthew J. Sciarrino, 11655 - 54th St. North, Clearwater, FL (US) 33760

( * ) Notice: Subject to any disclaimer, the term of this patent is extended or adjusted under 35 U.S.C. 154(b) by 2 days.

(21) Appl. No.: 10/195,605

(22) Filed: Jul. 15, 2002

Related U.S. Application Data

(63) Continuation-in-part of application No. 09/801,206, filed on Mar. 7, 2001, now Pat. No. 6,448,875.

(51) Int. Cl.[7] ..... H01P 1/04
(52) U.S. Cl. ..... 333/254; 333/248
(58) Field of Search ..... 333/248, 254–257

(56) References Cited

U.S. PATENT DOCUMENTS

| | | | | |
|---|---|---|---|---|
| 3,189,854 A | * | 6/1965 | Hubbard | 333/255 |
| 5,396,247 A | | 3/1995 | Watanabe et al. | |
| 5,525,899 A | | 6/1996 | Watanabe et al. | |
| 6,255,976 B1 | | 7/2001 | Watanabe et al. | |
| 6,307,496 B1 | | 10/2001 | Ikuta et al. | |
| 6,448,875 B1 | * | 9/2002 | Sciarrino | 333/254 |
| 6,583,693 B2 | * | 6/2003 | Paynter et al. | 333/254 |

FOREIGN PATENT DOCUMENTS

| | | |
|---|---|---|
| JP | A-5-259907 | 10/1993 |
| JP | A-5-37378 | 2/1995 |
| JP | A-7-154256 | 6/1995 |
| JP | A-11-44585 | 2/1999 |
| JP | A-11-64135 | 3/1999 |
| JP | A-2000-283790 | 10/2000 |

* cited by examiner

*Primary Examiner*—Don Le

(57) ABSTRACT

An interconnection system comprises mating male and female connectors. The male connector has a first end with an outer face and a second end with an inner face, an aperture passing through the center, radially extending flanges coplanar with the inner face and recesses formed between the flanges with a first circumference. The female connector has a central aperture passing there through, receivers with lips having an edge with the first circumference. When mated in the locked state, the flanges of the male connector form a coplanar coupling with the receivers of the female connector with the central apertures aligned and at least one bore passing through both connectors.

6 Claims, 6 Drawing Sheets

FIG 1
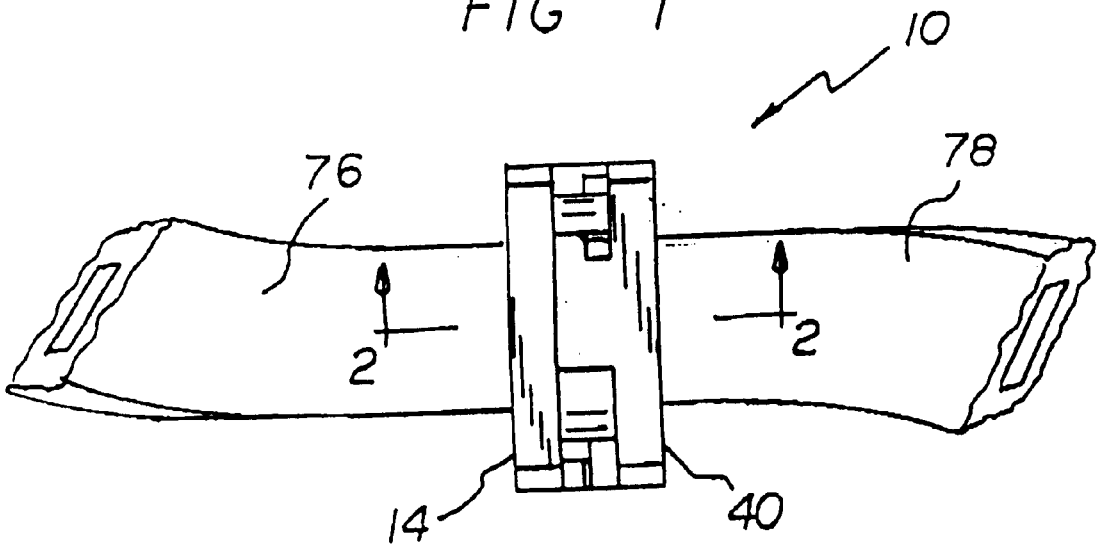
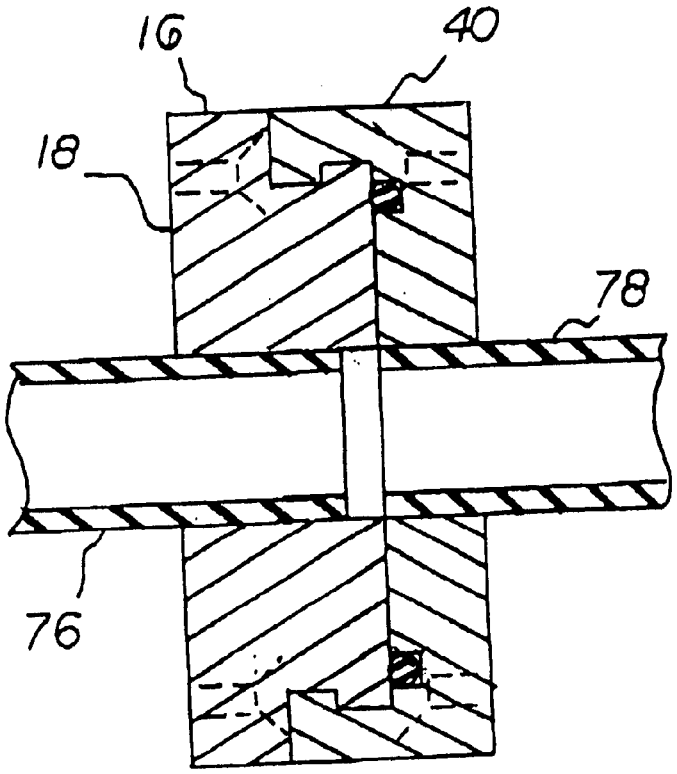
FIG 2

FIG 3
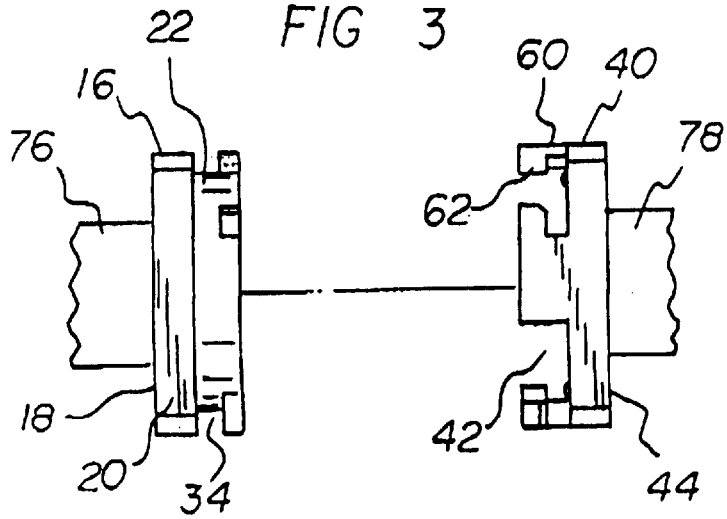
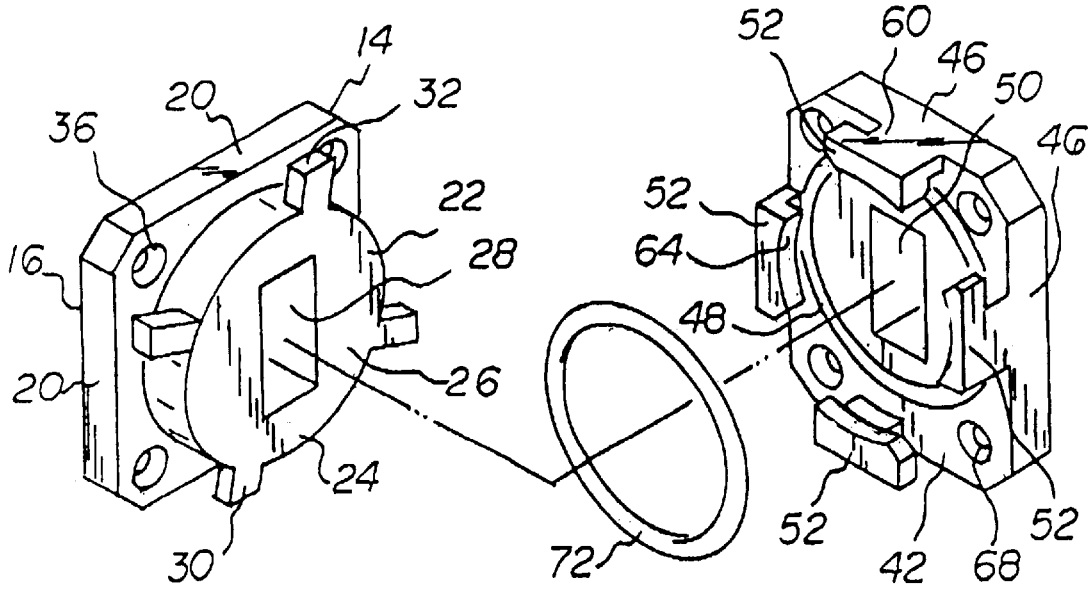
FIG 4

FIG 7
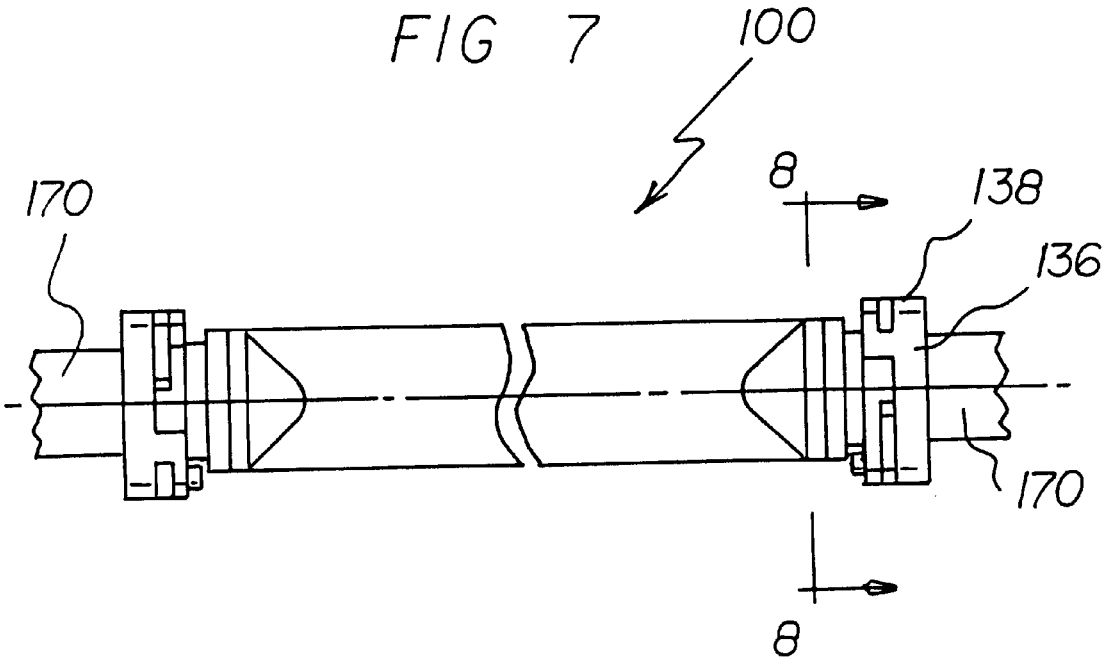
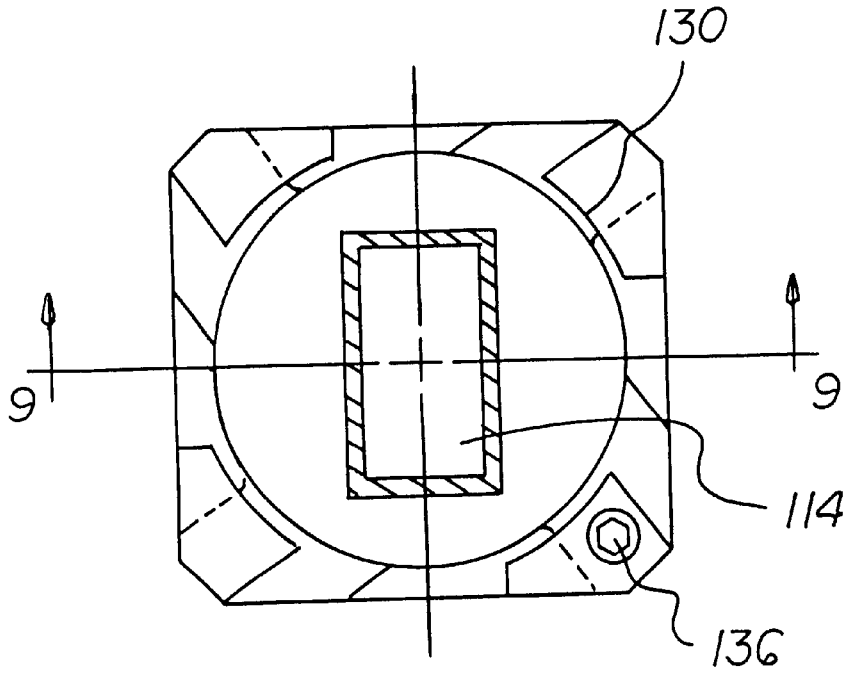
FIG 8

FIG 11
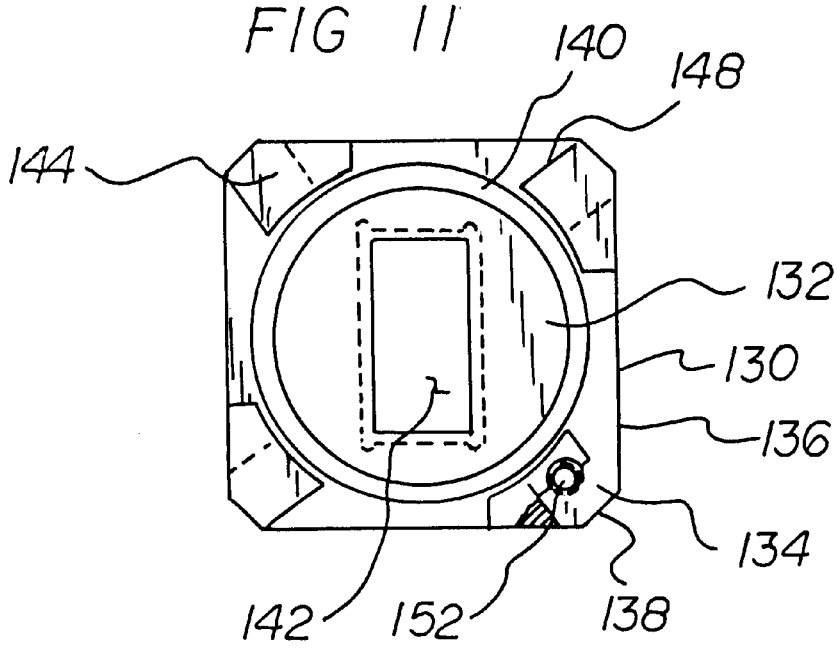
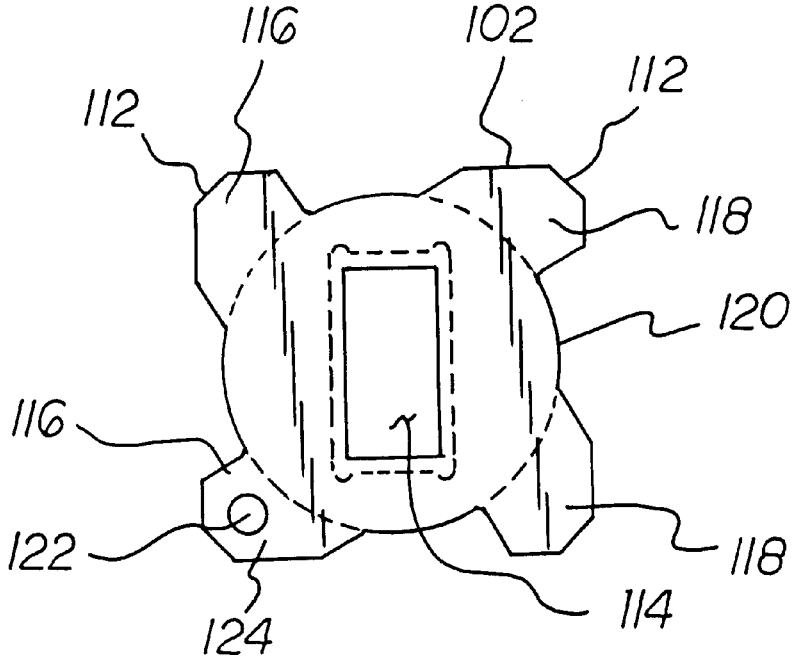
FIG 12

WAVEGUIDE INTERCONNECTION SYSTEM

RELATED APPLICATION

This application is a continuation-in-part of U.S. patent application Ser. No. 09/801,206 filed Mar. 7, 2001 now U.S. Pat. No. 6,448,875.

BACKGROUND OF THE INVENTION

1. Field of the Invention

The present invention relates to a waveguide interconnection system for effecting the rapid connection and disconnection of facing components.

2. Description of the Prior Art

The use of connection systems of known designs and configurations is known in the prior art. More specifically, connection systems of known designs and configurations previously devised and utilized for the purpose of connecting and disconnecting components through-known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,605,041 to Judkins, et al discloses a permanent waveguide connection for occasional use. U.S. Pat. No. 4,011,532 to Williams et al discloses a fast acting waveguide coupler. U.S. Pat. No. 5,364,136 to Forti et al discloses flanges and bodies for microwave waveguides components. Lastly, U.S. Pat. No. 6,140,893 to Sciarrino discloses a waveguide interconnection system.

While these devices fulfill their respective, particular objectives and requirements, the aforementioned patents do not describe a waveguide interconnection system that allows for effecting the rapid connection and disconnection of facing components.

In this respect, the waveguide interconnection system according to the present invention substantially departs from the conventional concepts and designs of the prior art, and in doing so provides an apparatus primarily developed for the purpose of effecting the rapid connection and disconnection of facing components.

Therefore, it can be appreciated that there exists a continuing need for a new and improved waveguide interconnection system which can be used for effecting the rapid connection and disconnection of facing components. In this regard, the present invention substantially fulfills this need.

SUMMARY OF THE INVENTION

In view of the foregoing disadvantages inherent in connection systems of known designs and configurations now present in the prior art, the present invention provides an improved waveguide interconnection system. As such, the general purpose of the present invention, which will be described subsequently in greater detail, is to provide a new and improved waveguide interconnection system which has all the advantages of the prior art and none of the disadvantages.

To attain this, the present invention essentially comprises a improved waveguide interconnection system for effecting the rapid connection and disconnection of facing components. First provided is a male connector. The male connector has a first end of a generally cylindrical configuration with an outer face. The male connector also has a second end. A generally rectangular portion of the male connector extends inwardly with respect to the system with an inner face and four corners. The male connector further has a rectangular aperture extending through both the ends and faces. The second end has four male flanges extending radially in the corners of the second end. The flanges are also angularly displaced from each other by 90 degrees. The male flanges have end faces coplanar with the inner face of the second end. Recesses are formed between the flanges and have the same circumference as the first end. The male connector also has a bore positioned in a first flange. Next provided is a female connector. The female connector has a generally rectangular configuration with an inner face, an outer face, a plurality of side faces and a plurality of corners. The female connector also has an annular recessed ring in the inner face. The female connector further has a rectangular aperture extending through both faces of the female connector and aligning with the rectangular aperture of the male connector when in a locked state. The female connector has four L-shaped female receivers. Each receiver has a base coplanar with its associated side face and a lip extending horizontally towards its adjacent corner. The lip also has an arcuate edge configured to match the circumference of the recesses of the male connector. The lips of the female connector are adapted to accept the flanges of the male connector. The bases of the receivers are positioned adjacent to each corner such that when in the locked state the flanges of the male connector form a coplanar coupling with the receivers of the female connectors. Bores are positioned in a first corner of the female connector and passing through its associated lip aligning with the bores of the male connector when in the locked state. A pin is adapted to pass through the bores and hold the system in the locked state. An O-ring is next provided. The O-ring resides within the recessed ring of the female connector allowing for a snug fit when in the locked state. A pair of elastomeric cables are provided. The elastomeric cables are in rectangular configurations and are coupled to the rectangular aperture of the male and female connectors. A first cable of the pair forming a coplanar connection with the inner face of the female connector. A second cable of the pair is formed just short of the inner face of the male connector.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved waveguide interconnection system which has all of the advantages of the prior art connection systems and none of the disadvantages.

It is another object of the present invention to provide a new and improved waveguide interconnection system which may be easily and efficiently manufactured and marketed.

It is further object of the present invention to provide a new and improved waveguide interconnection system which is of durable and reliable constructions.

An even further object of the present invention is to provide a new and improved waveguide interconnection system which is susceptible of a low cost of manufacture with regard to both materials and labor, and which accordingly is then susceptible of low prices of sale, thereby making such waveguide interconnection system economically available.

Even still another object of the present invention is to provide a waveguide interconnection system for connecting and disconnecting components.

Lastly, it is an object of the present invention to provide an interconnection system having mating male and female connectors. The male connector has a first end with an outer face and a second end with an inner face, an aperture passing through the center, radially extending flanges coplanar with the inner face and recesses formed between the flanges with a first circumference. The female connector has a central aperture passing there through, receivers with lips having an edge with the first circumference. When mated in the locked state, the flanges of the male connector form a coplanar coupling with the receivers of the female connector with the central apertures aligned and at least one bore passing through both connectors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the new and improved waveguide interconnection system constructed in accordance with the principles of the present invention.

FIG. 2 is a cross-sectional view of the system taken along line 2—2 of FIG. 1.

FIG. 3 is an exploded side view of the system shown in FIGS. 1 and 2.

FIG. 4 is an exploded perspective view of the system shown in prior Figures.

FIG. 7 is a perspective illustration of another embodiment of the present invention.

FIG. 8 is an end view of the FIG. 7 embodiment taken along line 8—8 of FIG. 7.

FIG. 11 is an end view of the female connector taken along line 11—11 of FIG. 9.

FIG. 12 is an end view of the male connector taken along line 12—12 of FIG. 9.

The same reference numerals refer to the same parts throughout the various Figures.

DESCRIPTION OF THE PREFERRED EMBODIMENT

Figure 5:
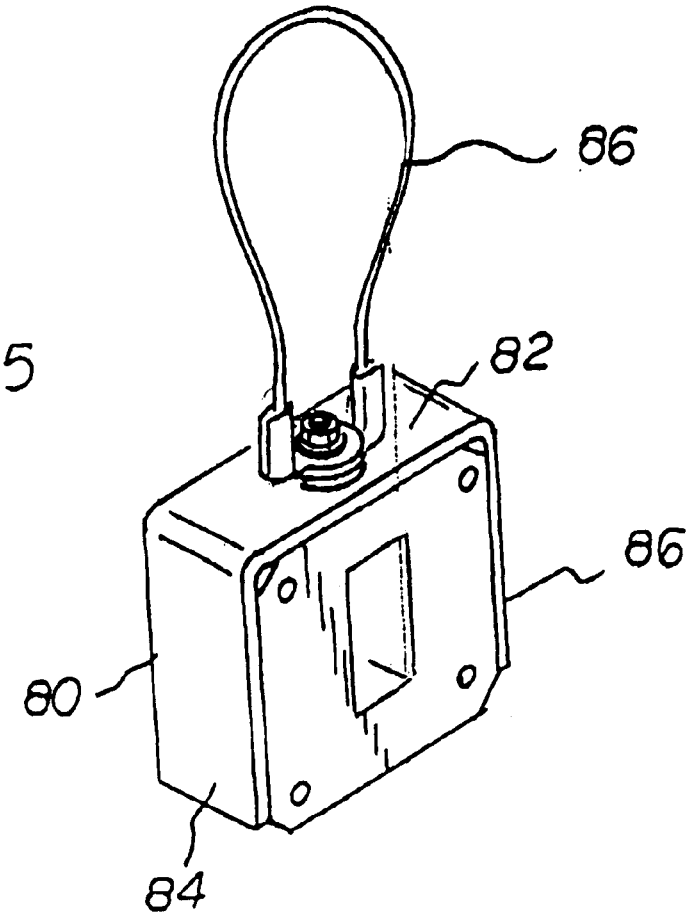
FIG. 5 is perspective view of a support device as a component of the present invention.
Figure 6:
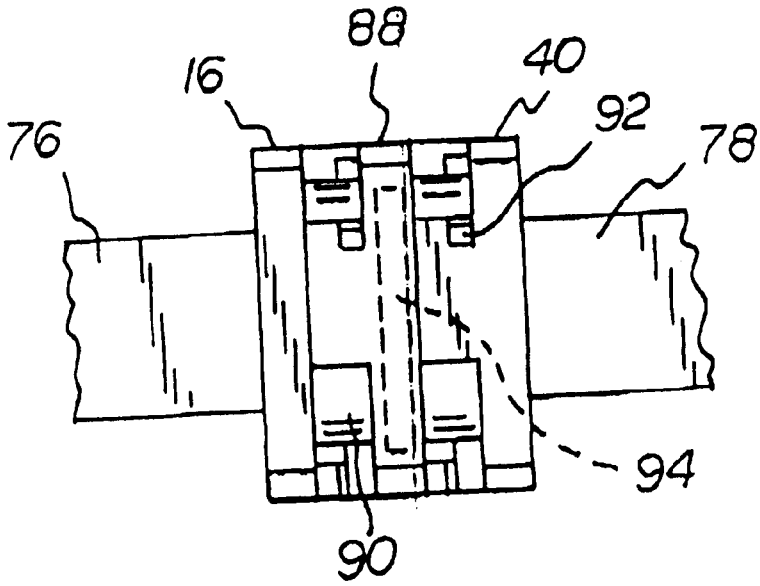
FIG. 6 is side view of the present invention with an intermediate portion supporting a filter.

With reference now to the drawings, and in particular to FIGS. 1–6 thereof, the preferred embodiment of the new and improved waveguide interconnection system embodying the principles and concepts of the present invention and generally designated by the reference numeral 10 will be described.

The present invention, the waveguide interconnection system 10 is comprised of a plurality of components. Such components in their broadest context include a male connector, a female connector, an o-ring and a pair of elastomeric cables. Such components are individually configured and correlated with respect to each other so as to attain the desired objectives.

First provided is a male connector 14. The male connector has a first end 16 of a generally rectangular configuration. The first end has an outer face 18 and a plurality of side faces 20. The male connector also has a second end 22. The second end comprises a cylindrically shaped portion 24 extending inwardly with respect to the system. The second end has an inner face 26. The male connector also has a rectangular aperture 28 extending through both the ends and faces.

The second end has four male flanges 30 extending generally radially with end faces 32 formed coplanar with the side faces of the first end. The flanges are coplanar with the inner face of the second end. Recesses 34 are formed between the flanges and the first end of the male connector. The flanges are angularly displaced from each other by 90 degrees. A plurality of bores 36 are positioned in the corners of the first end of the male connector.

Next provided is a female connector 40. The female connector has a generally rectangular configuration with an inner face 42, an outer face 44 and a plurality of side faces 46. The female connector also has an annular recessed ring 48. Further, the female connector has a rectangular aperture 50 extending through both faces of the female connector and aligning with the rectangular aperture of the male connector when in a locked state.

The female connector has four L-shaped female receivers 52. Each female receiver has a base 60 being coplanar with its associated side face and a lip 62 extending towards the rectangular aperture. The lip also has an arcuate edge 64 configured to match the circumference of the cylindrically extending portion of the male connector. The lips extend tangentially from the bases forming recesses to accept the flanges of the male connector. The bases of the receivers are positioned 90 degrees from each other and are symmetrically located with respect to the central axis of the system. In this manner, when in the locked state, the flanges of the male connector form a rectangular coplanar surface with the receivers of the female connectors. A plurality of bores 68 are positioned in the corners of the female connector and aligning with the bores of the male connector when in the locked state. This allows for the use of threaded fasteners to extend through the aligned bores of the male and female fasteners for thereby achieving a more secure coupling.

Provided next is an o-ring 72. The o-ring is provided to reside within the ring of the female connector allowing for a snug fit when in the locked state.

Also provided are a pair of elastomeric cables 76, 78. The cables are in a rectangular configuration and coupled to the rectangular aperture of the male and female connectors. One cable forms a coplanar connection with the inner face of the female connector. The other cable is formed just short of the inner face of the male connector. The cables are formed with central rectangular apertures there through aligned with the apertures of the connectors for the passage of microwave transmissions. The cables are formed of an elastomeric material, plastic or rubber, natural or synthetic, or blends thereof. The cables are resilient so that they will return to their original shapes, normally linear, after a deforming force has been removes. The cables are also flexible so they may be deformed as when coupling or uncoupling the male and female connectors.

The system preferably includes a U-shaped support mechanism 80. This U-shaped support mechanism has a top face 82 and a pair of parallel side faces 84 and is adapted to slide over the system when in the locked state. When covering the system the support mechanism faces come into contact with three faces of the system. Additionally, the top face has a hoop 86 attached thereto for being grasped during the removal and application of the support mechanism.

The system may further include an intermediate portion 88. This intermediate portion has a female connector 90 adapted to couple with the male connector of the system. The intermediate portion also has a male connector 92 adapted to couple with the female connector of the system. The central region of the intermediate portion is adapted to support a filter 94 in the path of travel of microwave transmissions through the cables. The filter functions to modify the transmitted microwaves.

Figure 9:
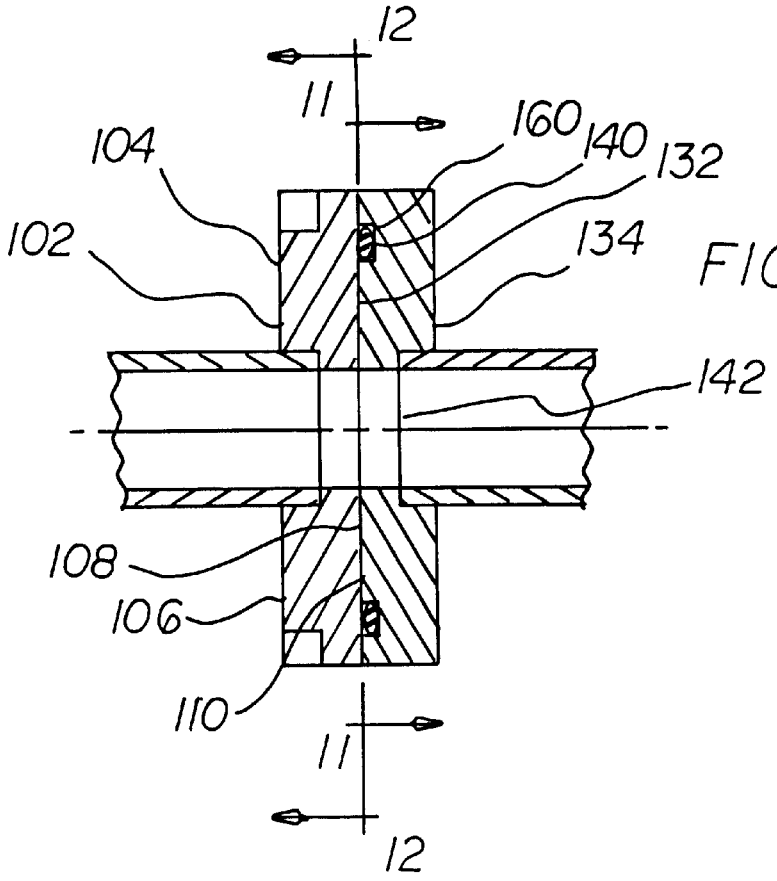
FIG. 9 is a cross sectional view taken along line 9—9 of FIG. 8.
Figure 10:
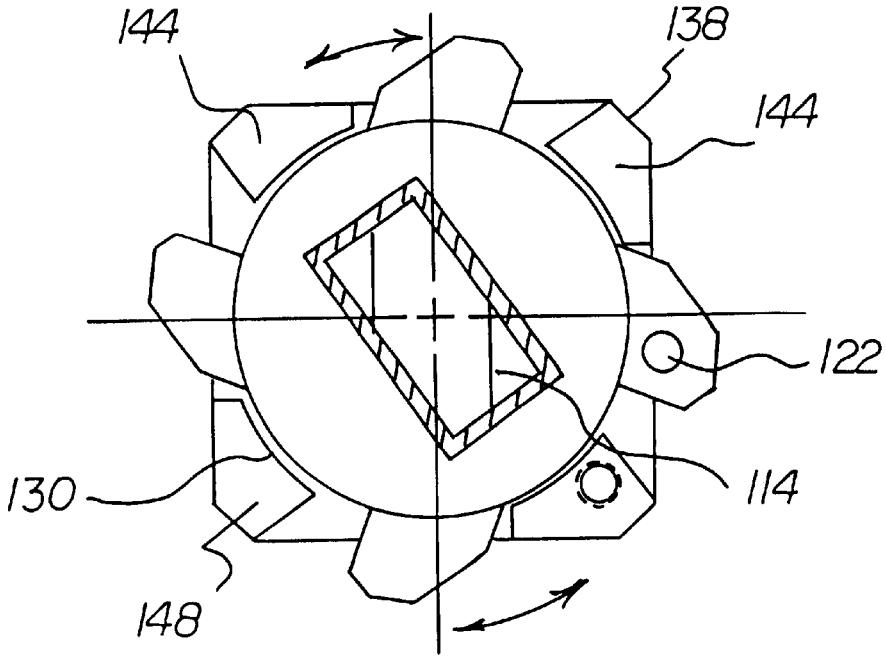
FIG. 10 is an end view of the FIG. 7 embodiment prior to it being in the locked state.

An additional embodiment of the invention is shown in FIGS. 7 through 12. This embodiment is an improved waveguide interconnection system 100 for effecting the rapid connection and disconnection of facing components. First provided in this embodiment is a male connector 102. The male connector has a first end 104 of a generally cylindrical configuration with an outer face 106. The male connector also has a second end 108. A generally rectangular portion of the male connector extends inwardly with respect to the system with an inner face 110 and four corners 112. The male connector further has a rectangular aperture 114 extending through both the ends and faces. The second end has four male flanges 116 extending radially in the corners of the second end. The flanges are also angularly displaced from each other by 90 degrees. The male flanges have end faces 118 coplanar with the inner face of the second end. Recesses 120 are formed between the flanges and have the same circumference as the first end. The male connector also has a bore 122 positioned in a first flange 124.

Next provided in this embodiment is a female connector 130. The female connector has a generally rectangular configuration with an inner face 132, an outer face 134, a plurality of side faces 136 and a plurality of corners 138. The female connector also has an annular recessed ring 140 in the inner face. The female connector further has a rectangular aperture 142 extending through both faces of the female connector and aligning with the rectangular aperture of the male connector when in a locked state. The female connector has four L-shaped female receivers 144. Each receiver has a base 146 coplanar with its associated side face and a lip 148 extending horizontally towards its adjacent corner. The lip also has an arcuate edge 150 configured to match the circumference of the recesses of the male connector. The lips of the female connector are adapted to accept the flanges of the male connector. The bases of the receivers are positioned adjacent to each corner such that when in the locked state the flanges of the male connector form a coplanar coupling with the receivers of the female connectors. Bores 152 are positioned in a first corner 154 of the female connector and passing through its associated lip aligning with the bores of the male connector when in the locked state. A pin 156 is adapted to pass through the bores and hold the system in the locked state.

An O-ring 160 is provided. The O-ring resides within the recessed ring of the female connector allowing for a snug fit when in the locked state.

A pair of elastomeric cables 170 are provided. The elastomeric cables are in rectangular configurations and are coupled to the rectangular aperture of the male and female connectors. A first cable of the pair forming a coplanar connection with the inner face of the female connector. A second cable of the pair is formed just short of the inner face of the male connector.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A waveguide interconnection system for effecting the rapid connection and disconnection of facing components comprising, in combination;

a male connector having a first end of a generally cylindrical configuration with an outer face, the male connector also having a second end comprising a generally rectangular portion extending inwardly with respect to the system with an inner face and having four corners, the male connector further having a rectangular aperture extending through both the ends and faces, the second end having four male flanges extending radially in the corners of the second end, the flanges also being angularly displaced from each other by 90 degrees, the male flanges having end faces being coplanar with the inner face of the second end, with recesses formed between the flanges and having the same circumference as the first end, the male connector also having a bore positioned in a first flange;

a female connector having a generally rectangular configuration with an inner face, an outer face and a plurality of side faces and a plurality of corners, the female connector also having an annular recessed ring in the inner face, the female connector further having a rectangular aperture extending through both faces of the female connector and aligning with the rectangular aperture of the male connector when in a locked state, the female connector having four L-shaped female receivers each with a base being coplanar with its associated side face and a lip extending horizontally towards adjacent corner, the lip also having an arcuate edge configured to match the circumference of the recesses of the male connector, the lips of the female connector being adapted to accept the flanges of the male connector, the bases of the receivers being positioned adjacent to each corner such that when in the locked state the flanges of the male connector form a coplanar coupling with the receivers of the female connectors, a bores being positioned in a first corners of the female connector and passing through its associated lip being aligning with the bores of the male connector when in the locked state and a pin adapted to pass through the bores and hold the system in the locked state;

an O-ring to reside within the recessed ring of the female connector allowing for a snug fit when in the locked state; and a pair of elastomeric cables with a rectangular configuration being coupled to the rectangular aperture of the male and female connectors, a first cable of the pair forming a coplanar connection with the inner face of the female connector and a second cable of the pair being formed just short of the inner face of the male connector.

2. An interconnection system comprising:

a male connector having a first end with an outer face and the second end with an inner face and an aperture passing through the center thereof and radially extending flanges being coplanar with the inner face of the male connector and recesses formed between the flanges with a first circumference; and a female connector having a central aperture passing there through and further having receivers with lips having an edge also with the first circumference, the female connector being configured to mate with the male connector such that when in the locked state the flanges of the male connector to form a coplanar coupling with the receivers of the female connector with the central aperture of the male connector aligning with the central aperture of the female connector and with at least one bore passing through both the male connector and the female connector in the locked state.

3. The interconnection system as set forth in claim 2 and further including and O-ring residing within a recessed ring of the female connector allowing for a snug fit when in the locked state.

4. The interconnection system as set forth in claim 2 and further including a pair of elastomeric cables with a rectangular configuration being coupled to a rectangular aperture of the male and female connectors, a first cable of the pair forming a coplanar connection with the inner face of the female connector and a second cable of the pair being formed just short of the inner face of the male connector.

5. The interconnection system as set forth in claim 2 wherein four bores pass through both the male and female connectors at 90 degrees from each other and a pin passes through each bore.

6. The interconnection system as set forth in claim 2 wherein one bore passes through both the male and female connector and a pin passes through the bore.

* * * * *